US007342754B2

(12) United States Patent
Fitzgerald et al.

(10) Patent No.: US 7,342,754 B2
(45) Date of Patent: Mar. 11, 2008

(54) BYPASS CIRCUIT TO PREVENT ARCING IN A SWITCHING DEVICE

(75) Inventors: Edward Aloysius Fitzgerald, deceased, late of Myakka City, FL (US); by Robin Fitzgerald, legal representative, Myakka City, FL (US); Sean Tillman Sande, Bradenton, FL (US); Murray Robert Ellsworth, Bradenton, FL (US)

(73) Assignee: Eaton Corporation, Cleveland, OH (US)

( * ) Notice: Subject to any disclaimer, the term of this patent is extended or adjusted under 35 U.S.C. 154(b) by 208 days.

(21) Appl. No.: 10/791,323

(22) Filed: Mar. 2, 2004

(65) Prior Publication Data

US 2005/0195550 A1 Sep. 8, 2005

(51) Int. Cl.
*H01H 9/30* (2006.01)

(52) U.S. Cl. ..... 361/2

(58) Field of Classification Search ..... 361/2
See application file for complete search history.

(56) References Cited

U.S. PATENT DOCUMENTS 3,437,188 A * 4/1969 Long ..... 192/103 R
3,694,765 A * 9/1972 Beurrier ..... 330/165
4,959,746 A * 9/1990 Hongel ..... 361/13
5,536,980 A 7/1996 Kawate et al. ..... 307/116
6,347,024 B1 * 2/2002 Blain et al. ..... 361/3
6,643,112 B1 11/2003 Carton et al. ..... 361/152
6,863,789 B2 * 3/2005 Sellers ..... 204/298.08
2002/0080003 A1 6/2002 Pellon et al. ..... 337/55

OTHER PUBLICATIONS

Theisen et al., 270-V DC Hybrid Switch, *IEEE Transactions of Components, Hybrids, and Manufacturing Technology*, vol. CHMT-9, No. 1, Mar. 1986, pp. 97-100.
Krstic et al., Push-Button Hybrid Switch, *IEEE Transactions of Components, Hybrids, and Manufacturing Technology*, vol. CHMT-9, No. 1, Mar. 1986, pp. 101-105.
IEEE Transactions on Components, Hybrids, and Manufacturing Technology, vol. CHMT-9, No. 1, Mar. 1986 Push-Button Hybrid Switch by Slobodan Krstic and Peter J. Theisen, 1986, pp. 101-105.
IEEE Transactions on Components, Hybrids, and Manufacturing Technology, vol. CHMT-9, No. 1, Mar. 1986 270-V DC Hybrid Switch by Peter J. Theisen and Slobodan Krstic, Member, IEE, And C. G. Chen, Member, IEEE, pp. 97-100.

* cited by examiner

*Primary Examiner*—Michael Sherry
*Assistant Examiner*—Luis Román
(74) *Attorney, Agent, or Firm*—Boyle Fredrickson, S.C.

(57) ABSTRACT

A device is provided for preventing arcing between contacts of a switching device as the contacts of the switching device are opened. The device includes a coil suppression circuit connected in parallel with the coil. The coil suppression circuit dissipates the energy stored in the coil in response to the de-energization of the coil. A first solid state switch has a gate operatively connected to the coil suppression circuit and is connected in parallel with the contacts. The first solid state switch is movable between an open position preventing the flow of current therethrough and a closed position in response to the dissipation of energy by the coil suppression circuit.

16 Claims, 3 Drawing Sheets

OR

BYPASS CIRCUIT TO PREVENT ARCING IN A SWITCHING DEVICE

FIELD OF THE INVENTION

This invention relates generally to switching devices, and in particular, to a bypass circuit that eliminates the arcing between the contacts of a switching device when the contacts are open.

BACKGROUND AND SUMMARY OF THE INVENTION

As is known, electromagnetic switching devices are often used to electrically couple a power source to a load such as an electrical motor or the like. The electromagnetic switching device includes both fixed and movable electrical contacts, as well as, an electromagnetic coil. Upon energization of the electromagnetic coil, the movable contact engages the fixed contact so as to electrically couple the power source to the load. When the electromagnetic coil is de-energized, the movable contact disengages from the fixed contact thereby disconnecting the load from the power source. However, as the contacts are separated, current continues to flow therebetween resulting in an arc between the contacts if minimum arc voltages and arc currents are present. Repeated or continued arcing between the contacts interferes with the ability of the contacts to conduct electricity and may cause the surface of the contacts to become eroded, pitted, or develop carbon build-up. Further, in circuits with high voltage sources, elimination of the continued arcing between the contacts may require special contact configurations, arc chutes, vacuum sealed devices or gas back filled devices. These arc-eliminating devices increase the size and weight of the switching devices. Hence, it is highly desirable to minimize or eliminate the potential for arcing between the contacts of a switching device without resorting to use of these arc-eliminating devices.

Various devices have been developed to minimize the arcing that may occur between the contacts of a switching apparatus such as an electromechanical switching device. By way of example, Kawate et al., U.S. Pat. No. 5,536,980 discloses a high voltage, high current switching apparatus that incorporates various protector devices that are used in the event of a circuit malfunction. The switching apparatus incorporates a single pole, double throw switching device and a solid state power switch. When the coil of the switching device is energized, the contact arm of the switching device moves into engagement with a first load contact that is operatively connected to a load. When the coil is de-energized, the contact arm of the switching device moves into contact with a second contact which is operatively connected to the gate of an IGBT switch. The collector of the IGBT switch is interconnected to the first load contact. Upon energization of the coil switching device, the movable contact moves toward the first load contact and the switch is turned on. Since the time required for the movable contact to move from the second contact to the first load contact is much greater than the switch turn-on time, the switch will be on prior to engagement of the movable contact with the first load contact. As a result, arcing between the movable contact and the first load contact is eliminated.

When the coil is de-energized, the movable contact starts to move away from the first load contact toward the second contact. Since the IGBT switch is already on, all of the current will flow through the IGBT switch until the movable contact engages the second contact. When the movable contact engages the second contact, the IGBT switch is turned off thereby turning off the load.

While the switching apparatus disclosed in the Kawate et al., '980 patent minimizes the arcing between the contacts of a switching device during switching, the circuit disclosed therein has certain inherent problems. More specifically, the circuit disclosed in the '980 patent functions to switch the load between the power source and ground. As such, the load may remain hot after the switching process thereby resulting in a potential of shock hazard from the load for a user. Further, the switch remains on whenever the first load contact of the switching device is closed. As a result, the circuit disclosed in the Kawate et al., '980 patent dissipates a significant amount of heat and utilizes a significant amount of power.

Therefore, it is a primary object and feature of the present invention to provide a bypass circuit that minimizes the arcing between the contacts of a switching device during the opening thereof.

It is a further object and feature of the present invention to provide a bypass circuit for minimizing the arcing between the contacts of a switching device that dissipates less heat and utilizes less power than prior bypass circuits.

It is a still further object and feature of the present invention to provide a bypass circuit for minimizing the arcing between contacts of a switching device that is simple and inexpensive to implement.

It is a still further object and feature of the present invention to provide a bypass circuit to eliminate arcing between contacts of a switching device that may be utilized with any switching device regardless of contact configuration and without the use of additional contacts for controlling the bypass circuit.

In accordance with the present invention, a device is provided for preventing arcing between the contacts of an electromechanical switching device as the contacts of the switching device are opened. The switching device includes a coil for controlling the opening and closing of the contacts. The device includes a coil suppression circuit connected in parallel with the coil. The coil suppression circuit dissipates the energy stored in the coil in response to the de-energizing of the coil. The device further includes a solid state switch having a gate operatively connected to the coil suppression circuit. The solid state switch is also connected in parallel with the contacts. The switch is movable between an open position for preventing the flow of current therethrough and a closed position in response to the dissipation of energy by the coil suppression circuit.

The coil suppression circuit includes a first zener operatively connected to the coil. The first zener diode provides a reference voltage in response to the de-energizing of the coil. A driver has an input operatively connected to the first zener diode and an output operatively connected to the gate of the solid state switch. The driver closes the solid state switch in response to a reference voltage across the first zener diode. The driver may also include a timing device for closing the solid state switch for a predetermined period of time.

The coil suppression circuit may also include a second diode operatively connected to the coil in series with the first zener diode. The first zener diode is biased in a first direction and the second diode is biased in a second opposite direction.

Alternatively, the driver may include a transformer. The transformer has a primary side operatively connected to the coil suppression circuit and a secondary side interconnected to the gate of the solid state switch. The transformer transfers electrical energy from the coil suppression circuit to the gate of the solid state switch. A zener diode may be connected in parallel to the second side of the transformer and the transformer has a preferred turn ratio of 1:1.

The first solid state switch includes a collector operatively connected to a first contact and an emitter. In addition, the device may include a second solid state switch. The second solid state switch may include a collector operatively connected to the emitter of the first solid state switch, an emitter operatively connected to a second contact of the switching device, and a gate operatively connected to the gate of the first solid state switch. A first diode extends between the collector and the emitter of the first solid state switch. The first diode is biased in a first direction. A second diode extends between the collector and the emitter of the second solid state switch. The second diode is biased in a second direction.

In accordance with a further aspect of the present invention, a bypass circuit is provided for preventing arcing of electrical energy passing between first and second contacts of an electromagnetic switching device having a coil wherein the contacts open and close in response to energization of the coil. The bypass circuit includes a first switch connected in parallel with the contacts of the electromagnetic switching device. The first switch is movable between a closed position with the contacts open and an open position with the contacts closed. An actuation circuit interconnects the coil and the first switch. The actuation circuit closes the first switch in response to de-energization of the coil.

The actuation circuit includes an energy dissipation device operatively connected to the coil to dissipate a portion of the energy released by the coil as the coil is de-energized. A driver interconnects the energy dissipation device and the first switch. The driver closes the first switch in response to a portion of the energy dissipated by the energy dissipation device. The energy dissipation device may take the form of a zener diode. The driver may take the form of a transformer. The transformer has a primary side operatively connected to the energy dissipation device and a secondary side operatively connected to the first switch.

It is contemplated that the electrical energy passing between the contacts have an AC waveform. As such, the bypass circuit may also include a second switch operatively connected to the actuation circuit and connected in parallel with the contacts of the electromagnetic switching device. The second switch is movable between a closed position with the contacts open and an open position with the contacts closed.

In accordance with a still further aspect of the present invention, a bypass circuit is provided for preventing arcing of electrical energy passing between first and second contacts of an electromagnetic switching device having a coil wherein the contacts open and close in response to energization of the coil. The bypass circuit includes a first switch connected in parallel with the contacts of the electromagnetic switching device. The first switch is movable between an open position and a closed position. An energy dissipation device is operatively connected to the coil to dissipate a portion of the energy released by the coil as the coil is de-energized. A driver interconnects the energy dissipation device and the first switch. The driver closes the first switch prior to the opening of the contacts in response to the portion of the energy dissipated by the energy dissipation device.

The driver may take the form of a transformer having a primary side operatively connected to the energy dissipation device and a secondary side operatively connected to the first switch. If the electrical energy passing between the contacts has an AC waveform, the bypass circuit may include a second switch operatively connected to the driver and connected in parallel with the contacts of the electromagnetic switching device. The second switch is movable between an open position and a closed position. The driver closes the second switch prior to the opening of the contacts in response to the portion of energy dissipated by the energy dissipation device.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
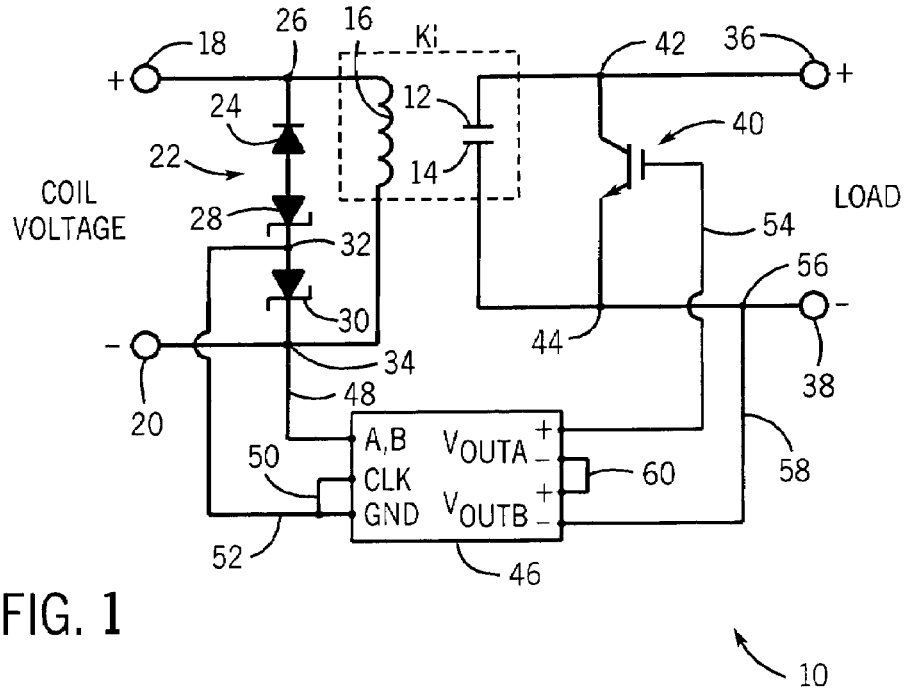
FIG. 1 is a schematic view of a first embodiment of a bypass circuit in accordance with the present invention.

Referring to FIG. 1, a bypass circuit in accordance with the present invention is generally designated by the reference numeral 10. It is intended that bypass circuit 10 minimize the arcing that may occur during the opening of contacts 12 and 14 of switching device K1 having electrical energy passing therethrough. As is conventional, switching device K1 includes coil 16 that controls the opening and closing of contacts 12 and 14. The first end of coil 16 is connected to positive terminal 18 of a coil voltage source and the second end of coil 16 is connected to negative terminal 20 of the coil voltage source.

A coil suppression circuit, generally designated by the reference numeral 22, is connected in parallel with coil 16. Coil suppression circuit 22 includes diode 24 having its cathode connected to positive terminal 18 of the coil voltage source at node 26 and its anode connected to the anode of zener diode 28. The cathode of zener diode 28 is connected to the anode of zener diode 30 at node 32 and the cathode of diode 30 is interconnected to the negative terminal 20 of the coil voltage source at node 34.

First contact 12 of switching device K1 is operatively connected to positive terminal 36 of a load and second contact 14 of switching device K1 is connected to negative terminal 38 of the load. Solid state switch 40, such as an IGBT, is connected in parallel with contacts 12 and 14 of switching device K1. The collector of solid state switch 40 is connected to positive terminal 36 of the load at node 42 and the emitter of solid state switch 40 is connected to negative terminal 38 of the load at node 44. The gate of solid state switch 40 is interconnected to coil suppression circuit 22 by driver 46, as hereinafter described. By way of example, driver 46 may take the form of a dual high voltage isolated driver, such as a Supertex HT0440.

Driver 46 generates two independent DC isolated voltages to outputs, $V_{OUTA}$ and $V_{OUTB}$, when the logic inputs at A and B of driver 46 are at logic high. Logic inputs A and B are interconnected to node 34 by line 48. The internal clock CLK of driver 46 and ground terminal GND of driver 46 are connected to node 32 by lines 50 and 52, respectively. The positive component of output voltage $V_{OUTA}$ is connected to the gate of solid state switch 40 by line 54 and the negative component of output voltage $V_{OUTB}$ is connected to negative terminal 38 of the load at node 56 by line 58. The negative component of output voltage $V_{OUTA}$ is connected to the positive component of output voltage $V_{OUTB}$ by jumper 60.

In order to close contacts 12 and 14 of switching device K1, a coil voltage is provided across positive and negative terminals 18 and 20, respectively. As current flows through coil 16, a magnetic field is generated which acts to close contacts 12 and 14 of switching device K1. With contacts 12 and 14 closed, current is free to flow to the load. It is noted that diode 24 of coil suppression circuit 22 is reversed biased such that the current flowing through coil 16 is prevented from flowing through coil suppression circuit 22. When the coil voltage access coil 16 is removed, coil 16 releases all of its energy. A portion of the energy released by coil 16 is dissipated by zener diode 30 such that logic inputs A and B of driver 46 are at logic high. This, in turn, generates a logic high at the positive component of output voltage $V_{OUTA}$ of driver 46 so as to turn solid state switch 40 on. Since the time required for turning solid state switch 40 on is significantly less than the time required for contacts 12 and 14 of switching device K1 to open in response to the de-energization of coil 16, the current flowing through contacts 12 and 14 is provided with a secondary path through solid state switch 40 prior to the opening of contacts 12 and 14. As contacts 12 and 14 of switching device K1 open, the current flow therethrough is transferred to solid state switch 40 thereby eliminating the arcing between contacts 12 and 14. When the energy stored in coil 16 is dissipated, the logic inputs A and B to driver 46 return to logic low. With logic inputs A and B at logic low, the positive component of the output voltage $V_{OUTA}$ returns to a logic low, thereby closing solid state switch 40. It is noted that since solid state switch 40 is powered from the energy stored in coil 16, bypass circuit 10 functions without any additional power sources. Further, since solid state switch 40 is only operated for a short period of time (e.g., 20 milliseconds), heat is not continually dissipated by solid state switch 40.

Figure 2:
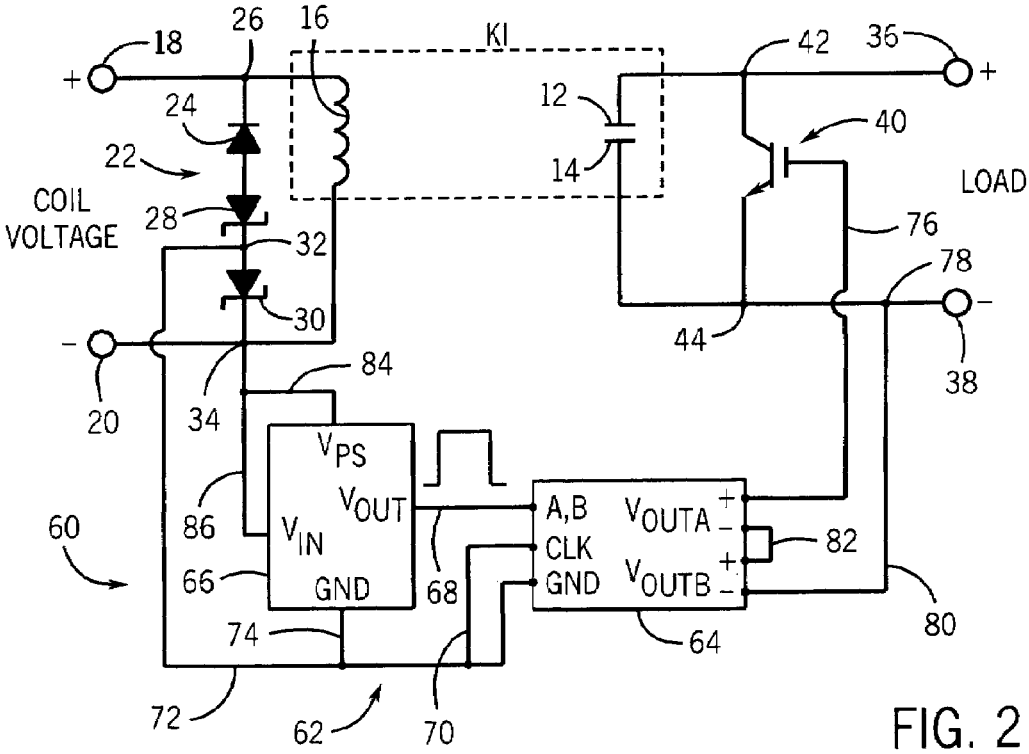
FIG. 2 is a schematic view of a second embodiment of a bypass circuit in accordance with the present invention.

Referring to FIG. 2, an alternate embodiment of a bypass circuit in accordance with the present invention is generally designated by the reference numeral 60. It is intended that bypass circuit 60 minimize the arcing that may occur during the opening of contacts 12 and 14 of switching device K1. As heretofore described, switching device K1 includes coil 16 that controls the opening and closing of contact 12 and 14. The first end of coil 16 is connected to positive terminal 18 of the coil voltage source and the second end of coil 16 is connected to negative terminal 20 of the coil voltage source.

Coil suppression circuit 22 is connected in parallel with coil 16, as heretofore described. First contact 12 of switching device K1 is operatively connected to positive terminal 36 of the load and second contact 14 of switching device K1 is connected to negative terminal 38 of the load. Solid state switch 40 is connected in parallel with contacts 12 and 14 of switching device K1. The collector of solid state switch 40 is connected to positive terminal 36 of the load at node 42 and the emitter of solid state switch 40 is negative terminal 38 of the load at node 44. Driver circuit 62 interconnects the gate of solid state switch 40 and coil suppression circuit 22, as hereinafter described.

Driver circuit 62 includes driver 64 and one shot 66. Driver 64 may take the form of a dual high voltage isolated driver, such as a Supertex HT00440. Driver 64 generates two independent DC isolated voltages to outputs $V_{OUTA}$ and $V_{OUTB}$ when the logic inputs at A and B of driver 64 are at logic high. Logic inputs A and B are interconnected to output $V_{OUT}$ of one shot 66 by line 68. The internal clock CLK of driver 64 and ground terminal GND of driver 64 are connected to node 32 by lines 70 and 72, respectively. In addition, ground terminal GND of one shot 66 is connected to line 72 through line 74. The positive component of the output voltage $V_{OUTA}$ of driver 64 is connected to the gate of solid state switch 40 by line 76 and the negative component of output voltage $V_{OUTB}$ of driver 64 is connected to the negative terminal 38 of the load at node 78 by line 80. The negative component of the output voltage $V_{OUTA}$ of driver 64 is connected to the positive component of the output voltage $V_{OUTB}$ of driver 64 by jumper 82. Internal power supply $V_{PS}$ of one shot 66 and input $V_{IN}$ to one shot 62 are connected to node 34 by lines 84 and 86, respectively.

In operation, a coil voltage is provided across positive and negative terminals 18 and 20, respectively, such that current flows through coil 16. As a result, a magnetic field is generated in coil 16 which acts to close contacts 12 and 14 of switching device K1. With contacts 12 and 14 of switching device K1 closed, current is free to flow therethrough to the load.

When the coil voltage across coil 16 is removed, coil 16 releases all of its energy. A portion of the energy released by coil 16 is dissipated by zener diode 30 such that input $V_{IN}$ to one shot 66 and internal power supply $V_{PS}$ of one shot 66 are at logic high. This, in turn, generates a logic high at output $V_{OUT}$ of one shot 66 for a predetermined time period.

With output $V_{PS}$ of one shot 66 at logic high, the logic inputs A and B of driver 64 are at logic high. This, in turn, generates a logic high at the positive component of output voltage $V_{OUTA}$ of driver 46 so as to turn solid state switch 40 on. Since the time required for turning the solid state switch 40 on is significantly less than the time required for contacts 12 and 14 of switching device K1 to open in response to the de-energization of coil 16, solid state switch 40 will be closed prior to the opening of contacts 12 and 14. As a result, as contacts 12 and 14 of switching device K1 open, the current flowing therethrough is transferred to solid state switch 40 thereby eliminating the arcing between contacts 12 and 14 of switching device K1.

At the conclusion of the predetermined time period, output $V_{OUT}$ of one shot 66 returns to logic low. As a result, with output $V_{OUT}$ of one shot 66 at logic low, the logic inputs A and B of driver 64 return to logic low such that the positive component of output voltage $V_{OUTA}$ of driver 64 returns to a logic low. With output voltage $V_{OUTA}$ of driver 64 at a logic low, solid state switch 40 opens. It can be appreciated that by limiting the period of time of solid state switch 40 is closed, the potential for rupture currents through solid state switch 40 is mitigated.

Figure 3:
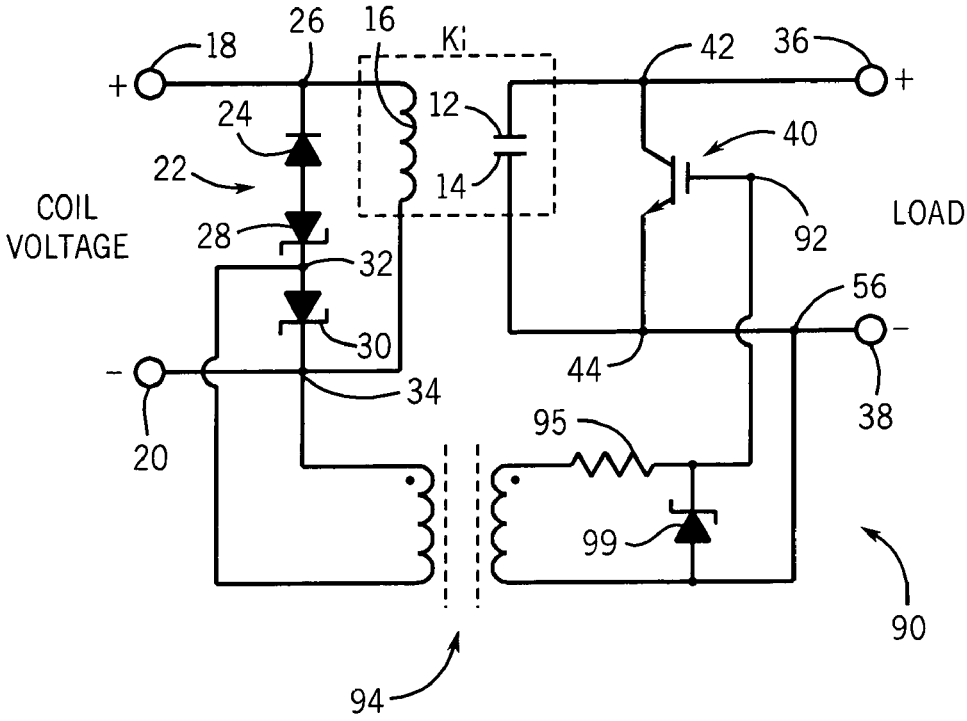
FIG. 3 is a schematic view of a third embodiment of a bypass circuit in accordance with the present invention.

Referring to FIG. 3, a third embodiment of a bypass circuit in accordance with the present invention is generally designated by the reference numeral 90. It is intended that bypass circuit 90 minimize the arcing that may occur during the opening of contacts 12 and 14 of electromechanical switching device K1. Switching device K1 includes coil 16 that controls the opening and closing of contacts 12 and 14. First end of coil 16 is connected to positive terminal 18 of the coil voltage source and second end of coil 16 is connected to negative terminal 20 of the coil voltage source. As heretofore described, coil suppression circuit 22 is connected in parallel with coil 16.

First contact 12 of switching device K1 is connected to positive terminal 36 of a load. Second contact 14 of switching device K1 is connected to negative terminal 38 of the load. Solid state switch 40 is connected in parallel with contacts 12 and 14 of switching device K1. The collector of solid state switch 40 is connected to positive terminal 36 of the load at node 42 and the emitter of solid state switch 40 is connected to negative terminal 38 of the load at node 44. The gate of solid state switch 40 is connected to node 92. Transformer 94 interconnects coil suppression circuit 22 and the gate of solid state switch 40.

In operation, a coil voltage is provided across positive and negative terminals 18 and 20, respectively, of coil 16. As current flows through coil 16, a magnetic field is generated which acts to close contacts 12 and 14 of switching device K1. With contacts 12 and 14 closed, current is free to flow through contacts 12 and 14 of switching device K1 to the load. When the coil voltage across coil 16 is removed, coil 16 releases all of its energy. A portion of the energy released by coil 16 is dissipated by zener diode 30 and transmitted to the primary side of transformer 94. The electrical energy flows through the primary side of transformer 94 so as to induce a corresponding voltage across the secondary side thereof thereby generating current flow. Zener diode 97 and current limiting resistor 95 are connected in series across the output terminals of the secondary side of transformer 94 to regulate the voltage and current provided to the gate of solid state switch 40 at node 92 and to turn solid state switch 40 on.

Since the time required for turning solid state switch 40 on is significantly less than the time required for contacts 12 and 14 of switching device K1 to open in response to the de-energization of coil 16, solid state switch 40 will close prior to the opening of contacts 12 and 14. As a result, as contacts 12 and 14 of switching device K1 open, the current flowing therethrough is transferred to solid state switch 40 thereby eliminating the arcing between contacts 12 and 14. When the energy stored in coil 16 is dissipated, the voltage across the primary side of transformer 94 returns to zero such that the voltage across secondary side of transformer 94 is also zero, thereby opening solid state switch 40.

Figure 4A:
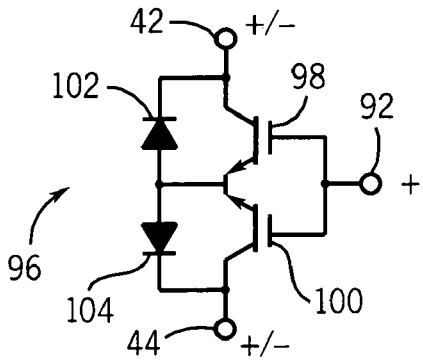
FIG. 4*a* is an alternate switch arrangement for use in the bypass circuit of FIG. 3.
Figure 4B:
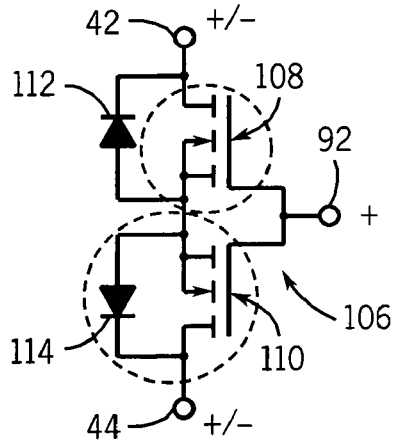
FIG. 4*b* is a second alternate switch arrangement for use in the bypass circuit of FIG. 3.

Referring to FIGS. 4*a*-4*b*, in the event that switching device K1 is used to interconnect an AC power source to the load, solid state switch 40 is replaced by dual solid state switches to handle the positive and negative half cycles of the AC waveform. By way of example, referring to FIG. 4*a*, an alternate switch configuration is generally designated by the reference numeral 96. Switch configuration 96 includes a first solid state switch such as IGBT 98, and a second solid state switch, such as second IGBT 100, connected in series. The emitters of IGBT's 98 and 100 are interconnected. The collector of first IGBT 98 is interconnected to positive terminal 36 of the load at node 44 and the collector of second IGBT 100 is connected to the negative terminal of the load at node 44. Diode 102 is connected to the parallel with first IGBT 98 such that the cathode of diode 102 is connected to the collector of first IGBT 98 and the anode of diode 102 is connected to the emitter of first IGBT 98. A second diode 104 is connected in parallel with second IGBT 100 and includes an anode interconnected to the emitter of second IGBT 100 and a cathode interconnected to the collector of second IGBT 100. The gates of first and second IGBT's 98 and 100, respectively, are electrically coupled to node 92.

In operation, a coil voltage is provided across positive and negative terminals 18 and 20, respectively. As current flows through coil 16, a magnetic field is generated which acts to close contacts 12 and 14 of switching device K1. With contacts 12 and 14 closed, AC current is free to flow through contacts 12 and 14 of switching device K1 to a load. When the coil voltage across coil 16 is removed, coil 16 releases all of its energy. A portion of the energy released by coil 16 is dissipated by zener diode 30 and transmitted to the primary side of transformer 94. As the electrical energy flows through the primary side of the transformer so as to induce a corresponding voltage across the secondary side thereof thereby generating current flow. Zener diode 97 and current limiting resistor 95 are connected in series across the output terminals of the secondary side of transformer 94 to regulate the voltage and current provided to the gates of first and second IGBT switches 98 and 100, respectively, at node 92 and to turn first and second IGBT switches 98 and 100, respectively, on.

Since the time required for turning first and second IGBT switches 98 and 100, respectively, on is significantly less than the time required for contacts 12 and 14 of switching device K1 to open in response to the de-energization of coil 16, first and second IGBT's 98 and 100, respectively, will be on prior to the opening of contacts 12 and 14. As a result, as contacts 12 and 14 of switching device K1 open, the AC current flowing therethrough is transferred to switch configuration 96. More specifically, during its positive half cycle, the AC current flows through first IGBT 98 and second diode 104. During the negative half cycle, the AC current flows through first diode 102 and second IGBT 100. As a result, the AC current flowing through contacts 12 and 14 of switching device K1 is transferred to switch configuration 96 thereby eliminating the arcing between contacts 12 and 14. When the energy stored in coil 16 is dissipated, the voltage across the primary side of transformer 94 returns to zero such that the voltage across secondary side of transformer 94 is also zero, thereby opening first and second IGBT switches 98 and 100, respectively.

Referring to FIG. 4*b*, a second alternative switch configuration is generally designated by the reference numeral 106. Switch configuration 106 includes a first solid state switch, such as first MOSFET switch 108, and a second solid state switch, such as second MOSFET switch 110, connected in series. The emitters of MOSFET switches 108 and 110 are interconnected. The source of first MOSFET switch 108 is interconnected to positive terminal 36 of the load at node 44 and the source of second MOSFET switch 110 is connected to negative terminal of the load at node 44. Diode 112 is connected in parallel with first MOSFET switch 108 such that the cathode of diode 112 is connected to the source of first MOSFET switch 108 and the anode of diode 112 is connected to the drain of first MOSFET switch 108. Second diode 114 is connected in parallel with second MOSFET switch 110 and includes an anode interconnected to the drain of second MOSFET switch 110 and a cathode interconnected to the source of second MOSFET switch 110. The gates of first and second MOSFET switches 108 and 110, respectively, are electrically coupled to node 92.

In operation, a coil voltage is provided across positive and negative terminals 18 and 20, respectively. As current flows through coil 16, a magnetic field is generated which acts to close contacts 12 and 14 of switching device K1. With contacts 12 and 14 closed, AC current is free to flow through contacts 12 and 14 of switching device K1 to the load. When the coil voltage across coil 16 is removed, coil 16 releases all of its energy. A portion of the energy released by coil 16 is dissipated by zener diode 30 and transmitted to the primary side of transformer 94. The electrical energy flows through the primary side of transformer 94 so as to induce a corresponding voltage across the secondary side thereof thereby generating current flow. Zener diode 97 and current limiting resistor 95 are connected in series across the output terminals of the secondary side of transformer 94 to regulate the voltage and current provided to the gates of first and second MOSFET switches 108 and 110, respectively, at node 92 and to turn first and second MOSFET switches 108 and 110, respectively, on.

Since the time required for turning first and second MOSFET switches 108 and 110, respectively, on is significantly less than the time required for contacts 12 and 14 of switching device K1 to open in response to the de-energization of coil 16, first and second MOSFET switches 108 and 110, respectively, will be on prior to the opening of contacts 12 and 14. As a result, as contacts 12 and 14 of switching device K1 open, the AC current flowing therethrough is transferred to switch configuration 106. More specifically, during its positive half cycle, the AC current flows through first MOSFET switch 108 and second diode 114. During its negative half cycle, the AC current flows through first diode 112 and second MOSFET switch 110. As a result, the AC current flowing through contacts 12 and 14 of switching device K1 is transferred to switch configuration 106 thereby eliminating the arcing between contacts 12 and 14. When the energy stored in coil 16 is dissipated, the voltage across the primary side of transformer 94 returns to zero such that the voltage across secondary side of transformer 94 is also zero, thereby opening first and second MOSFET switches 108 and 110, respectively.

Figure 5:
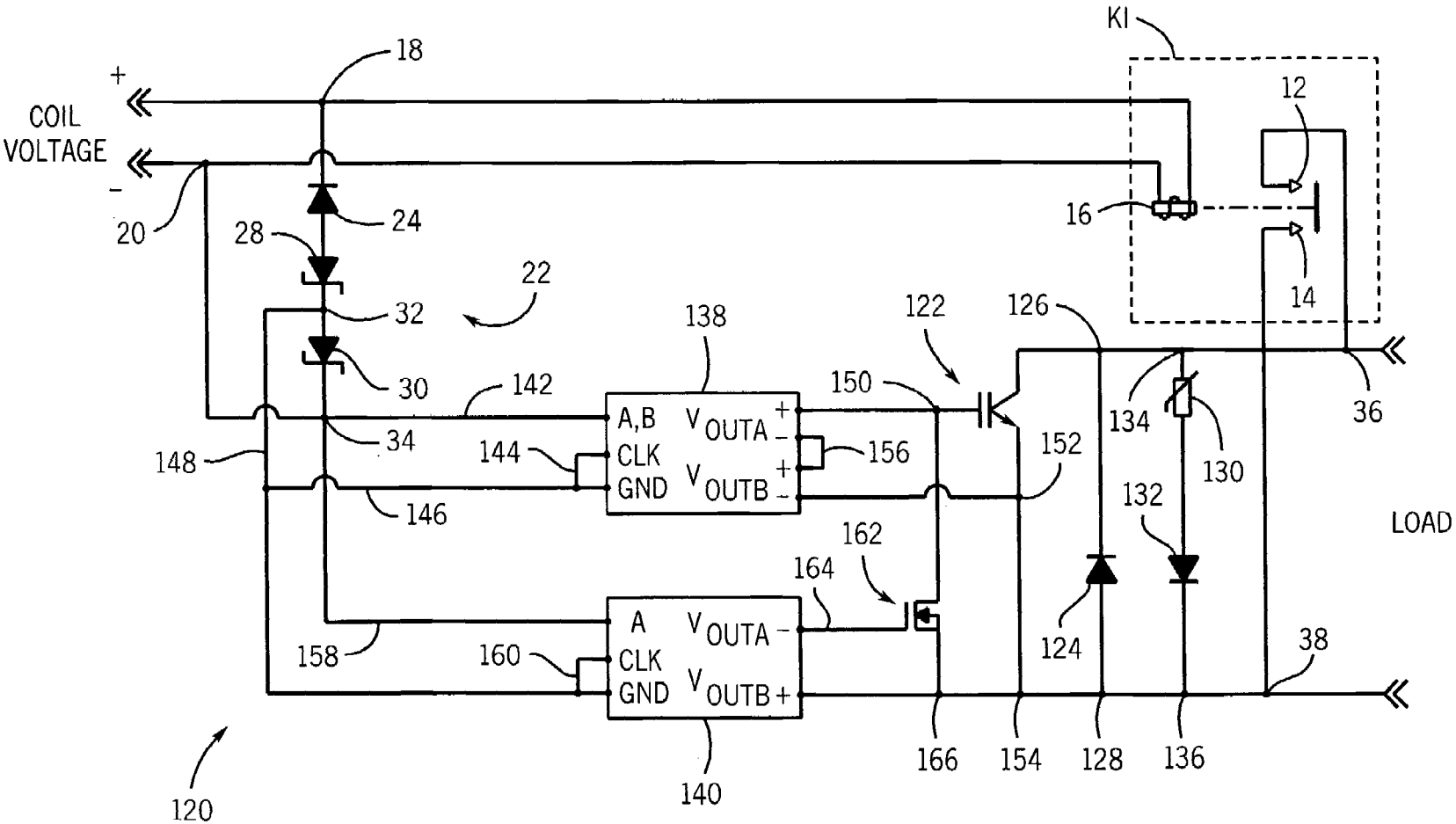
FIG. 5 is a fourth embodiment of a bypass circuit in accordance with the present invention.

Referring to FIG. 5, a still further embodiment of the bypass circuit in accordance with the present invention is generally designated by the reference numeral 120. It is intended bypass circuit 120 minimize the arcing that may occur during the opening of contacts 12 and 14 of switching device K1. Switching device K1 includes coil 16 that controls the opening and closing of contacts 12 and 14. First end of coil 16 is connected to positive terminal 18 of the coil voltage source and the second end of coil 16 is connected to negative terminal 20 of the coil voltage source. As heretofore described, coil suppression circuit 22 is connected in parallel with coil 16.

First contact 12 of switching device K1 is connected to positive terminal 36 of a load and second contact 14 of switching device K1 is connected to negative terminal 38 of the load. Solid state switch 122 is connected in parallel with contacts 12 and 14 of switching device K1. In addition, diode 124 is connected in parallel with solid state switch 122 such that the cathode of diode 124 is connected to positive terminal 36 of the load at node 126 and the anode of diode 124 is connected to negative terminal 38 of the load at node 128. Varistor 130 and diode 132 are connected to in series to each other and in parallel with contacts 12 and 14 of switching device K1. Varistor 130 has a first end connected to positive terminal 36 of the load at node 134 and a second end connected to the anode of diode 132. The cathode of diode 132 is connected to negative terminal 38 of the load at node 136.

Varistor 130 and diode 132 insure that transient voltages above the collector to emitter breakdown voltage of solid state switch 122 are not exceeded. As is known, when switching loads with inductance associated, large negative transients at the load can occur depending on how fast the current is driven to zero. Diode 124 allows any positive transients above the source voltage of solid state switch 122 to pass therethrough.

Bypass circuit 120 further includes first and second drivers 138 and 140, respectively, for controlling the opening and closing of solid state switch 122. Driver 138 generates two independent DC isolated voltages to outputs, $V_{OUTA}$ and $V_{OUTB}$, when the logic inputs at A and B of first driver 138 are logic high. Logic inputs A and B of first driver 138 are interconnected to node 34 by line 142. The internal clock CLK of first driver 138 and ground terminal GND of first driver 138 are connected to node 32 through lines 144 and 146, respectively, as well as through line 148. The positive component of output voltage $V_{OUTB}$ is connected to the gate of solid state switch 122 at node 150 and the negative component of output voltage $V_{OUTA}$ is connected to the emitter of solid state switch 122 at node 152 which, in turn, is connected to negative terminal 38 of the load at node 154. The negative component of output voltage $V_{OUTB}$ of driver 138 is connected to the positive component of output voltage $V_{OUTA}$ by jumper 156.

Second driver 140 generates an independent DC isolated voltage to output $V_{OUTA}$ when the logic input A of second driver 140 is at logic high. Logic input A is interconnected to node 34 by line 158. The internal clock of second driver 140 and ground terminal GND of second driver 140 are interconnected to node 32 by lines 160 and 148, respectively. The negative component of output voltage $V_{OUTA}$ is connected to the gate of MOSFET switch 162 by line 164. The emitter of MOSFET switch 162 is connected to negative terminal 38 of the load at node 166 and the source of MOSFET switch 162 is connected to the gate of solid state switch 122 at node 150.

In operation, a coil voltage is provided across positive and negative terminals 18 and 20, respectively, of coil 16. As current flows through coil 16, a magnetic field is generated which acts to close contacts 12 and 14 of switching device K1. With contacts 12 and 14 closed, current is free to flow through contacts 12 and 14 of switching device K1 to the load. When the coil voltage across coil 16 is removed, coil 16 releases all of its energy. A portion of the energy released by coil 16 is dissipated by zener diode 30 such that logic inputs A and B of first driver 148 and logic input A of second driver 140 are all at logic high. This, in turn, generates a logic high at the positive component of output voltage $V_{OUTA}$ of first driver 138, as well as, driving output voltage $V_{OUTA}$ of second driver 140. It can be appreciated that the negative component of output voltage $V_{OUTA}$ of second driver 140 drives the gate voltage of MOSFET switch 162 negative, turning the MOSFET switch off, while the positive component of output voltage $V_{OUTA}$ of first driver 138 turns solid state switch 122 on. Since the time required for turning the solid state switch 122 on is significantly less than the time required for contacts 12 and 14 of switching device K1 to open in response to the de-energization of coil 16, the current flowing through contacts 12 and 14 of switching device K1 is provided with a secondary path through solid state switch 122 prior to the opening of contacts 12 and 14. As contacts 12 and 14 of switching device K1 open, the current flowing therethrough is transferred to solid state switch 122 thereby eliminating the arcing between contacts 12 and 14.

When the energy stored in coil 16 is dissipated, logic inputs A and B to first driver 138 and the logic input A to second driver 140 return to logic low. With logic inputs A and B of first driver 138 at logic low, the positive component of output voltage $V_{OUTA}$ of second driver 138 returns to logic low. In addition, the logic input A to second driver 140 returns to logic low such that the output voltage $V_{OUTA}$ of second driver 140 returns to zero so as to close MOSFET switch 162. With MOSFET switch 162 on, solid state switch 122 is transitioned from on to off in a shorter period of time. This, in turn, reduces the power dissipated by solid state switch 122 during interruption of the current to the load.

Various modes of carrying out the invention are contemplated as being within the scope of the following claims particularly pointing out and distinctly claiming the subject matter that is regarded as the invention.

We claim:

1. A device for preventing arcing between contacts of a switching device as the contacts of the switching device are opened, the switching device including a coil for controlling the opening of the contacts, the device comprising:

a coil suppression circuit connected in parallel with the coil, the coil suppression circuit dissipating the energy stored in the coil in response to the de-energizing of the coil and including:

a first zener diode having a cathode connected to the coil and an anode; and a second zener diode having a cathode operatively connected to the anode of the first zener diode and an anode;

a driver having an input operatively connected to the anode of the first zener diode and an output; and a first solid state switch having a gate operatively connected to the output of the driver and being connected in parallel with the contacts, the first solid state switch movable between an open position preventing the flow of current therethrough and a closed;

wherein:

current flow to the driver is prevented in response to energization of the coil;

the first zener diode providing a reference voltage generated by the de-energization of the coil; and the driver closes the first solid state switch in response to the reference voltage across the first zener diode.

2. The device of claim 1 wherein the driver includes a timing device for closing the first solid state switch for a predetermined time period.

3. The device of claim 1 wherein the driver includes a transformer, the transformer having a primary side operatively connected to the coil suppression circuit and a secondary side interconnected to the gate of the first solid state switch, the transformer transferring electrical energy from the coil suppression circuit to the gate of the first solid state switch.

4. The device of claim 3 further comprising a zener diode connected in parallel with the secondary side of the transformer.

5. The device of claim 3 wherein the transformer has a turn ratio of 1:1.

6. The device of claim 1 comprising a second solid state switch connected in series with the first solid state switch.

7. The device of claim 6 further comprising:

a first diode connected in parallel with the first solid state switch, the first diode biased in a first direction; and a second diode connected in parallel with the second solid state switch, the second diode biased in a second direction.

8. A bypass circuit for preventing arcing of electrical energy passing between first and second contacts of a switching device having a coil wherein the contacts open and close in response to the energization of the coil, the bypass circuit comprising:

a first switch connected in parallel with the contacts of the switching device, the first switch movable between a closed position with the contacts open and an open position with the contacts closed;

a voltage reference device directly connected to the coil, the voltage reference device providing a reference voltage generated by de-energization of the coil; and an actuation circuit interconnecting the coil and the first switch, the actuation circuit closing the first switch in response to the reference voltage;

wherein the voltage reference device prevents current flow to the actuation circuit in response to energization of the coil.

9. The bypass circuit of claim 8 wherein the actuation circuit includes a transformer, the transformer having a primary side operatively connected to the voltage reference device and a secondary side operatively connected to the first switch.

10. The bypass circuit of claim 8 wherein the electrical energy passing between the contacts has an AC waveform and wherein the bypass circuit further comprises a second switch operatively connected to the actuation circuit and being connected in parallel with the contacts of the switching device, the second switch movable between a closed position with the contacts open and an open position with the contacts closed.

11. The bypass circuit of claim 8 further comprising a second switch operating connected to the first switch, the second switch controlling the rate of closure of the first switch.

12. A bypass circuit for preventing arcing of electrical energy passing between first and second contacts of a switching device having a coil wherein the contacts open and close in response to the energization of the coil, the bypass circuit comprising:

a first switch connected in parallel with the contacts of the switching device, the first switch movable between an open position and a closed position;

an energy dissipation device directly connected to the coil for providing a reference voltage for a predetermined time period generated by de-energization of the coil; and a driver interconnecting the energy dissipation device and the first switch, the driver closing the first switch prior to the opening of the contacts in response to the reference voltage;

wherein the energy dissipation prevents current flow to the driver in response to energization of the coil.

13. The bypass circuit of claim 12 wherein the driver is a transformer, the transformer having a primary side operatively connected to the energy dissipation device and a secondary side operatively connected to the first switch.

14. The bypass circuit of claim 13 further comprising a varistor connected in parallel with the contacts of the magnetic switching device.

15. The bypass circuit of claim 12 wherein the electrical energy passing between the contacts has an AC waveform and wherein the bypass circuit further comprises a second switch operatively connected to the driver and being connected in parallel with the contacts of the switching device, the second switch movable between an open position and a closed position.

16. The bypass circuit of claim 15 wherein the driver closes the second switch prior to the opening of the contacts in response to the reference voltage.

* * * * *